US007867082B2

(12) United States Patent
Vali-Tepper

(10) Patent No.: US 7,867,082 B2
(45) Date of Patent: Jan. 11, 2011

(54) GAME AND PRIZING METHOD

(75) Inventor: Ismail Vali-Tepper, Ware (GB)

(73) Assignee: Internet Opportunity Entertainment Limited (AG)

( * ) Notice: Subject to any disclaimer, the term of this patent is extended or adjusted under 35 U.S.C. 154(b) by 782 days.

(21) Appl. No.: 11/358,595

(22) Filed: Feb. 21, 2006

(65) Prior Publication Data

US 2007/0197280 A1 Aug. 23, 2007

(51) Int. Cl.
*A63F 9/24* (2006.01)

(52) U.S. Cl. ..... 463/25; 463/40; 463/41; 463/42

(58) Field of Classification Search ..... 463/40, 463/42

See application file for complete search history.

(56) References Cited

U.S. PATENT DOCUMENTS 5,768,382 A * 6/1998 Schneier et al. ..... 380/251
6,439,997 B1 * 8/2002 Brasseur et al. ..... 463/40

OTHER PUBLICATIONS

Greaves, Richard P. Brewster's Millions. 1903, McLeod & Allen, p. 29-30.*

"Internet game show tests Hartford area market in advance of national launch", Aug. 5, 2004, USA Today.*

* cited by examiner

*Primary Examiner*—Dmitry Suhol
*Assistant Examiner*—Werner Garner
(74) *Attorney, Agent, or Firm*—John Bruckner PC

(57) ABSTRACT

A game and prize method includes a prize awarded to a winner of a game, and the prize must be spent by the winner within a certain set time limit. However, in order to obtain the prize a player must participate in a game, preferably a tournament style game, with other people, and win the prize. The game may be against the other contestants in a knock-out style game, or may alternatively be against a computer, with a selection of one of the contestants being made based on random or deterministic criteria. However the winner is determined, the winner receives a money prize which must then be spent by the winner within a set time limit.

19 Claims, 7 Drawing Sheets

GAME AND PRIZING METHOD

BACKGROUND INFORMATION

1. Field of the Invention

The present invention relates to a method of playing a game and spending a resulting prize, and in particular to spending a resulting prize within a predetermined time limit, or alternatively or additionally to spending a resulting prize such that the recipient has no assets to show for the expenditure of at least a proportion of the prize. Additionally, the invention provides for the provision of a game and a prize for the winning of that game, and for the monitoring of the spending of the prize within the time limit. In preferred embodiments the prize must be spent within the time limits and the recipient must have no assets to show for the spending of the prize at the end of the time limit. In other embodiments no time limit is applied, but the winner must spend at least a proportion of the prize such that after the expenditure he has no assets to show therefor.

2. Discussion of the Related Art

The playing of games for money prizes is well known in the art. Various different forms of games are known, such as board games, card games, or the like and in the modern age games aired on TV and radio shows. More recently, with the rise of the Internet, Internet-based games with money prizes have also become popular and in particular online card games such as poker games or the like. Various online gaming services are known, such as, for example, ParadisePoker.com™ which is an online poker service associated with the present assignees. A screen shot of the ParadisePoker.com system is shown in FIG. 1, from which it will be seen that using a computer a player is shown a graphical depiction of a card table with their cards laid thereon, as well as graphical icons representing the other players. Further description of the ParadisePoker.com system necessary for the understanding of the present invention will be undertaken later.

Typically, money prizes won by playing such games were within the preserve of the winner to decide how to spend the prize, and over what time frame. That is, typically, winners have been free to choose how to spend prize money, and upon what, and in particular have been able to purchase assets with prize money.

Historically, however, it has previously been proposed in fictional art that a recipient of an amount of money must spend that money within a certain time limit, and moreover have no assets to show for the expenditure. The concept appears to have been first proposed in George Barr McCutcheon's novel "Brewster's Millions" dating from 1902. This novel has formed the basis of at least seven film adaptations in 1914, 1921, 1926, 1935, 1945, 1961 (entitled "Three On A Spree"), and most recently starring the late actor Richard Pryor in 1985. The plot in the book and each of the films is broadly similar comprising a down at heel character "Montgomery Brewster", who inherits a large sum of money (in the 1985 version $300 million). However, in order to obtain the inheritance Mr. Brewster must spend a substantial portion of the money within a set time limit (in the 1985 film version Mr. Brewster must spend $30 million in 30 days), and moreover have no assets to show for the expenditure. Only a small proportion of the money may be given away to charitable causes and provided that at the end of the time limit all of the money is spent Mr. Brewster receives the remainder of his inheritance.

SUMMARY OF THE INVENTION

The present invention extends the "Brewster's Millions" concept into the modern gaming environment, and particularly although not exclusively, into the modem on-line internet based gaming community. In particular from one aspect the present invention applies the time limit aspect of the "Brewster's Millions" concept to a prize awardable to a winner of a game, in that the prize must be spent by the winner within a certain set time limit. However, in order to obtain the prize within the present invention a player must participate in a game, preferably a tournament style game, with other people, and win the prize. The game may be against the other contestants in a knock-out style game, or may alternatively be against a computer, with a selection of one of the contestants being made based on random or deterministic criteria. Howsoever the winner is determined, the winner receives a money prize which must then be spent by the winner within a set time limit. In preferred embodiments the winner must spend the money in such a way that at the end of the time limit he or she has no assets to show for the money. In other embodiments, however, the winner may spend the prize on assets.

From another aspect, the time limit feature is not incorporated, but instead the winner must spend the prize in accordance with rules which stipulate that at least a proportion of the prize must be expended in such a manner that the winner has no assets to show for the expenditure.

In view of the above, from a first aspect the present invention provides a method for a game, comprising: providing a game for entry by players; once players have entered the game, running the game according to game rules to determine at least one of the players as a winner of the game; awarding the winner a money prize; setting a time limit for the winner to expend the money prize; and monitoring the expenditure of the money prize by the winner within the time limit.

In preferred embodiments of the invention the game is provided and run as an on-line game over the Internet, whereby the game is hosted on a game server connected to the Internet. In this way the "Brewster's Millions" concept can be extended to on-line gameplay.

Of course, preferably the monitoring comprises observing that the prize is spent within the time limit according to a set of rules. This ensures that the prize is spent legally, and moreover, where for example the game is run for entertainment purposes, that the prize is spent in ways that are entertaining to watch or listen to.

Moreover, in preferred embodiments and true to the "Brewster's Millions" concept the monitoring comprises observing that the prize is expended such that the winner, at the end of the time limit, has no assets to show for the expenditure of the prize. In other embodiments, however, the winner may have assets to show at the end of the time limit. In further embodiments, a proportion of the money prize may be spent on assets, the remaining portion then having to be expended such that there are no assets to show for the expenditure.

To ensure that expenditure is entertaining, and particularly where the game is run as a TV or radio show for entertainment purposes, the monitoring preferably further comprises determining a mode of expenditure of the prize by the winner, and providing said winner with said mode of expenditure. Thus, a panel of judges may determine how the winner should spend the prize, and for example provide the winner with a number of options for expenditure. The winner must then choose one of the options to expend the prize within the time limit.

Moreover, and again preferably as part of a TV or radio show, the method preferably further includes the step of observing the expenditure of said winner in accordance with the determined mode of expenditure. The maximum entertainment value of the expenditure can then be obtained.

In order to ensure, for example, that only certain players, for example certain players from a particular region those who have purchased a particular product, can enter the game, other embodiments of the invention provide a pass code to players, the pass code being for entry into the game, the game providing further comprising a step of obtaining the pass code from players prior to allowing entry into the game. In such a way, entry into the game can be limited to the certain players. For example, the pass code may be provided to players via a communications medium such as a TV or radio channel, or may instead be printed, for example on a newspaper, magazine, or on a purchased product or its packaging.

In other embodiments, preferably the monitoring further comprises recording audio and/or video recordings of said winner expending said prize. This is particularly suitable where the game is being run for entertainment purposes, for example in conjunction with a radio or TV show. In such embodiments preferably the recordings are transmitted to third parties via a communications medium, such as a radio, TV channel or Internet.

Concerning the game itself, preferably the game is a tournament game against other players. However, in other embodiments the game may be a game against a simulated opponent, such as a computer, and the winner is selected from a plurality of people who play the game according to one or more predetermined criteria. In particular the winner may be selected at random or alternatively based on player performance in the game. In the preferred embodiments the game is preferably a card game, and in the most preferred embodiments is a form of poker, although other games may equally be used.

From another aspect the invention also provides a method of playing a game for a prize, comprising the steps of: entering a game; playing the game according to game rules with the object of trying to win the game; if the game is won: i) receiving a money prize; and then ii) expending the money prize within a set time limit.

Preferably the expending step further comprises expending the prize such that the winner, at the end of the time limit, has no assets to show for the expenditure of the prize.

From a further aspect, the invention also provides a method for a game, comprising: providing a game for entry by players; once players have entered the game, running the game according to game rules to determine at least one of the players as a winner of the game; and awarding the winner a money prize on condition that the winner expend at least a proportion of the prize in such a manner that after the expenditure of the proportion he has no assets to show for the expenditure.

Preferably, in this further aspect there is also provided the step of monitoring the expenditure of the money prize by the winner in accordance with the stipulation.

BRIEF DESCRIPTION OF THE DRAWINGS

Further features and advantages of the present invention will become apparent from the following description of embodiments thereof, presented by way of example only, and by reference to the accompanying drawings, wherein like reference numerals refer to like parts, and wherein:—

DESCRIPTION OF PREFERRED EMBODIMENTS

Figure 1:
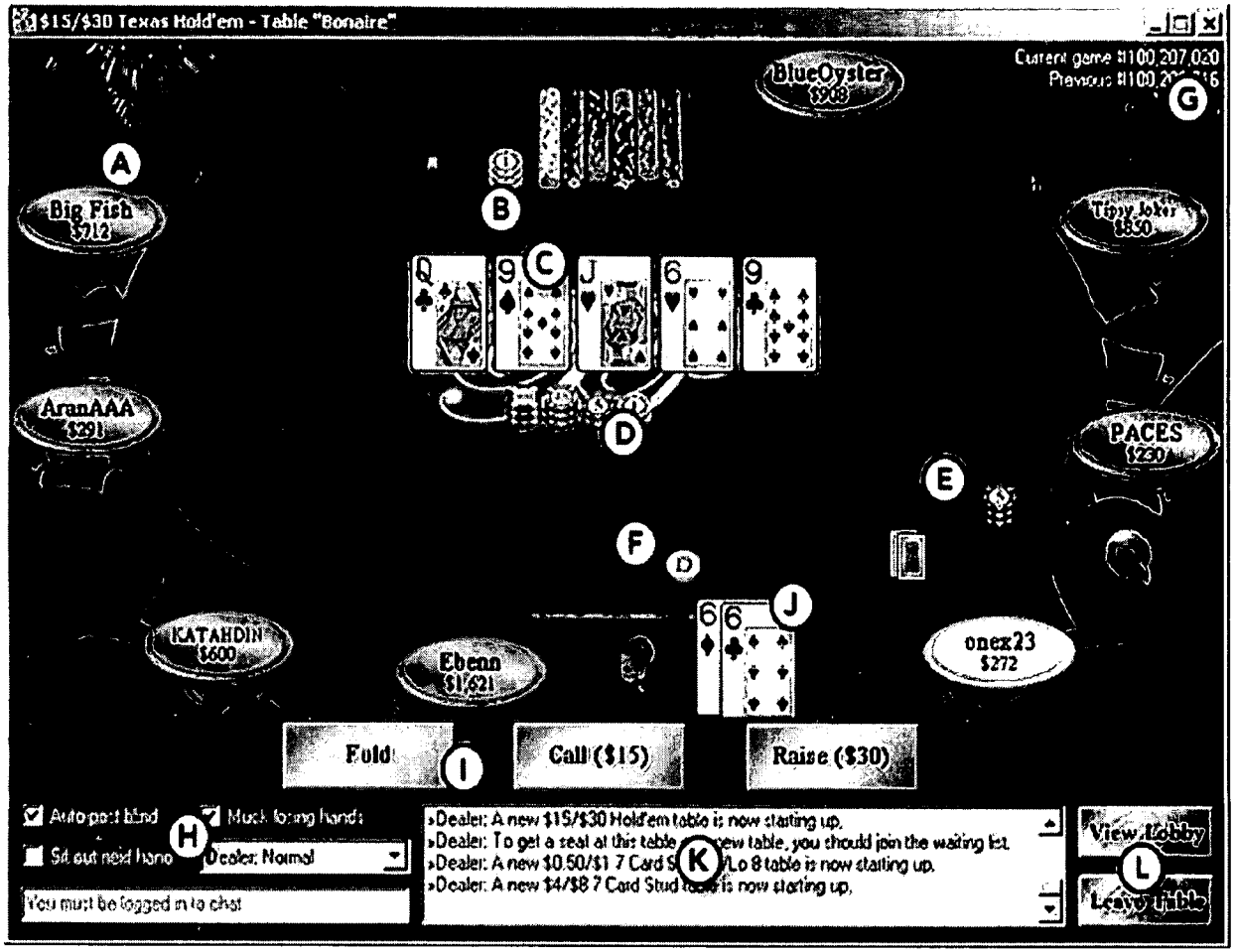
FIG. 1 is a screen shot of the prior art ParadisePoker.com™ online poker system.

In recent years the playing of online card games, and in particular games like poker has become increasingly popular. Many online poker websites are available. In the ParadisePoker.com™ system, the ParadisePoker.com™ client program is downloaded from a host server via the Internet, and installed on a user's local computer. The Paradise Poker.com™ client program contains all of the necessary graphics, sound, and control logic to allow the program to display to the user a simulated poker table and game. Additionally, the client program also contains the necessary software code to allow the client program to communicate via the Internet to a backend games server, upon which a virtual poker game is then instantiated, and wherein the state of the game is stored. By forming a logical connection over the Internet between the client program installed on the user computer and the backend games server, virtual poker games can be run, between different users who may be geographically located far away from each other. An example screen shot of the ParadisePoker.com™ system is shown in FIG. 1, and further details can be found. Any details necessary for understanding the present invention relating to the ParadisePoker.com™ system are hereby incorporated therein.

Figure 2:
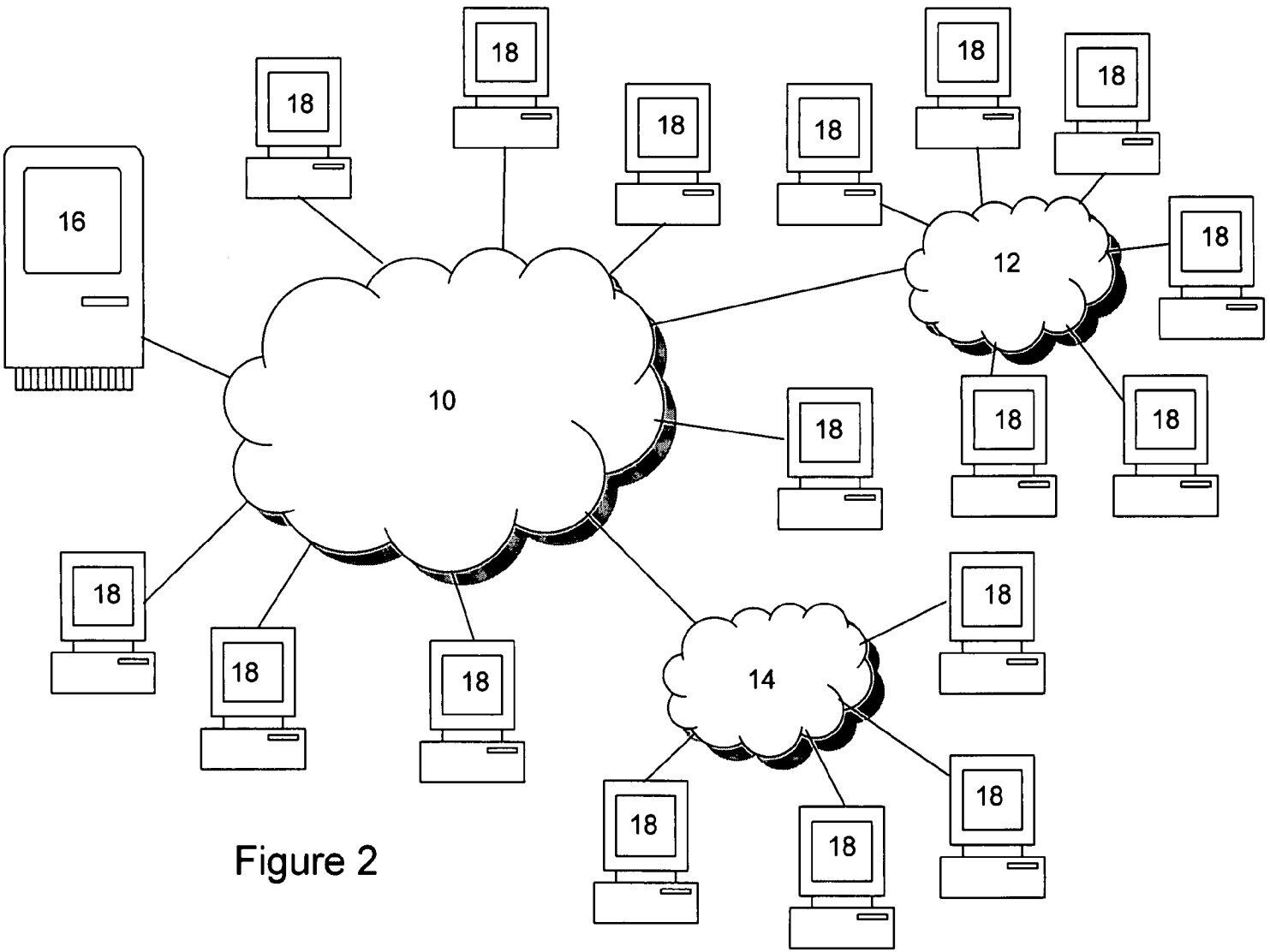
FIG. 2 is a block diagram illustrating how many online players may play a game hosted by a games server via an interconnected network such as the Internet.

As shown in FIG. 2, many players may play together at the same time using such a system. In particular, in FIG. 2 a plurality of individual players local user computers 18 are shown logically connected to a backend games server 16 hosting the games system, the logical connections being provided by a plurality of interconnected networks 10, 12 and 14, forming the Internet. Thus, when using, for example, the ParadisePoker.com™ system, each of the user computers 18 has the ParadisePoker.com™ client program installed thereon, which communicates with the backend game server 16 which holds instantiations of virtual poker games, and maintains the state of these poker games. Logical connections form between the user computers 18 and the backend games server 16 via the networks 10, 12 and 14 allowing for control signals to be passed therebetween, such that the client program running on each user computer 18 may update its display to keep track of the state of the game, thereby allowing a user to play the game. Such operation is entirely conventional, and well known in the art.

Figure 3:
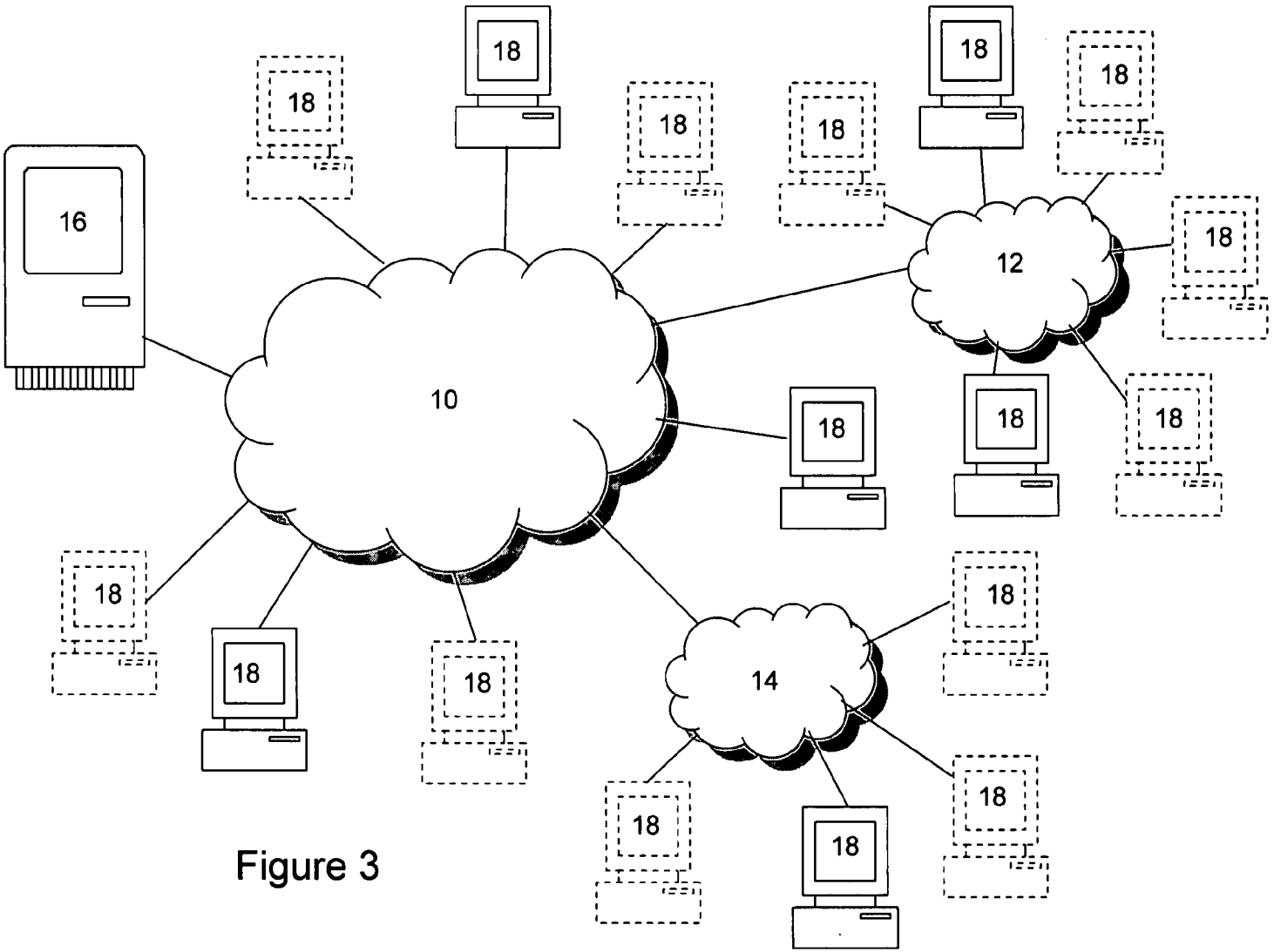
FIG. 3 is a block diagram illustrating how such an online game of FIG. 2 is played.
Figure 4:
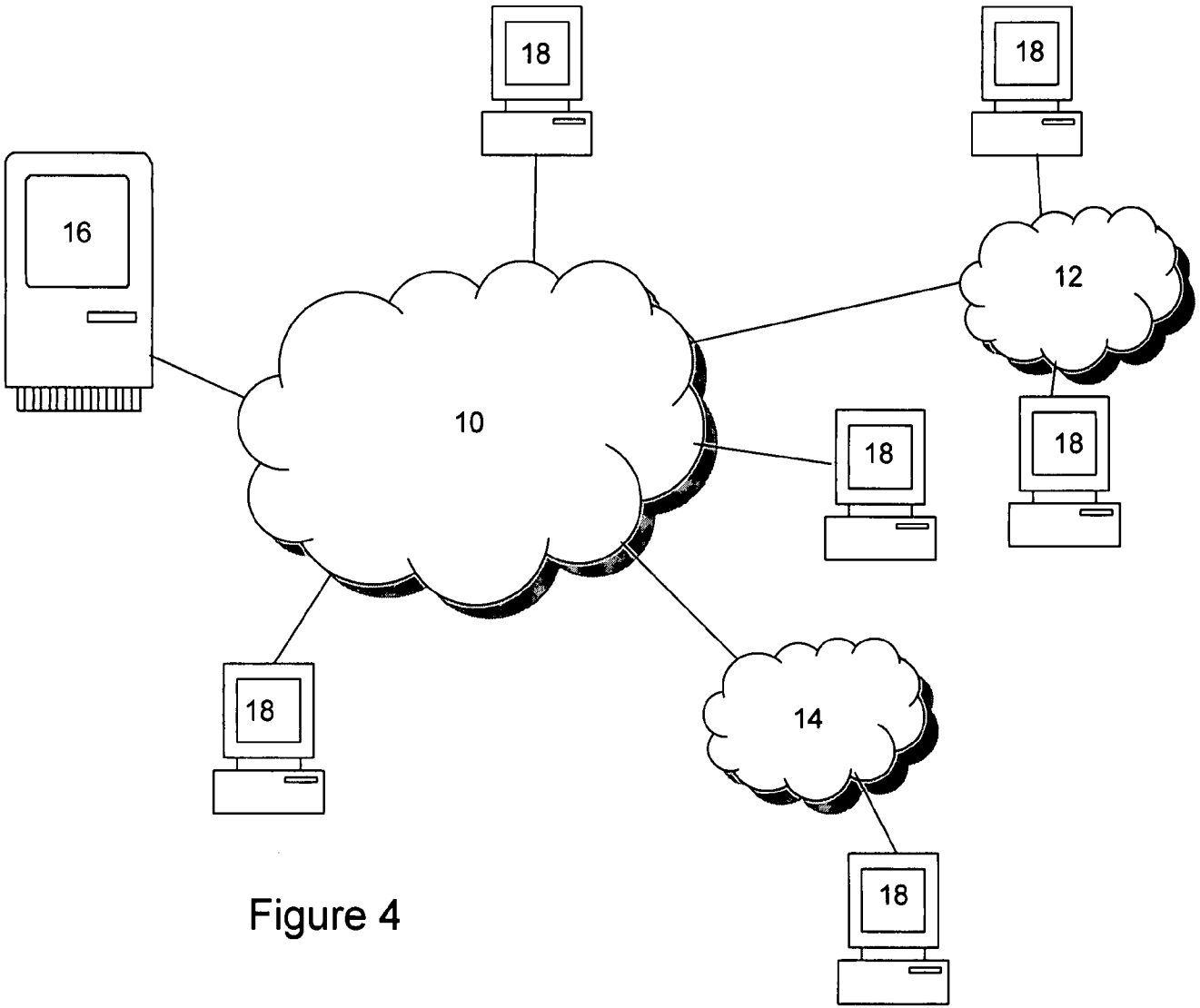
FIG. 4 is a block diagram illustrating how an online game of FIG. 2 may be played.
Figure 5:
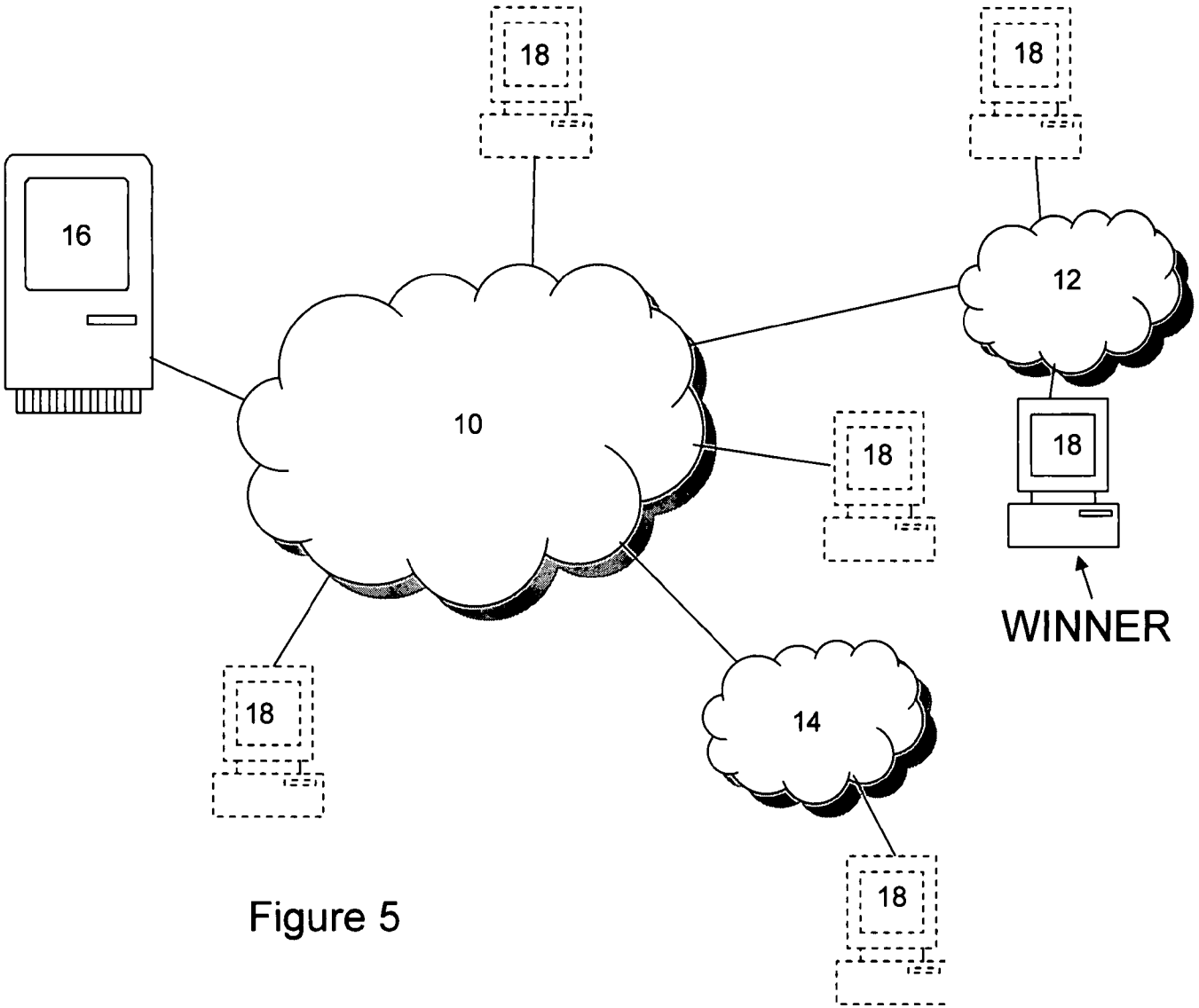
FIG. 5 is a block diagram illustrating how an online game of FIG. 2 may be played.

In the first embodiment described further below, an online poker game as described above is combined with the provision of a prize which must be expended within a set time limit. Therefore, as shown in FIG. 2 each of the players uses their local computers 18 to connect to the games server 16 and enter the virtual poker games instantiated thereon. Where, as shown in FIG. 2, there are too many players for a single virtual poker game, then a plurality of virtual poker games may be instantiated, and run simultaneously. For example, as shown in FIG. 1 each virtual poker "table" may only accommodate a certain number of players, commonly between 6 and 10. As the virtual poker games are run simultaneously, and players drop out of the games, as shown by the computers shown in dotted lines in FIG. 3, then the remaining players may be combined together into a single virtual poker game, as shown in FIG. 4. This final poker game is then continued, until a winner is determined, as shown in FIG. 5. Such an arrangement constitutes a poker tournament wherein multiple virtual games are held simultaneously, and then as the numbers of the players drop out, each game is "broken up" and reformed into a smaller number of games. This procedure continues iteratively until a single game is left, at which a single winner can be determined.

Once a single winner has been determined then in embodiments of the invention a money prize is provided to the winner, but with the condition that the prize must be expended within a set time limit, preferably somewhere between two and ten hours. Additionally, the prize may also stipulate a particular time period within which the prize must be expended. Such as, for example, between 1 pm and 6 pm in the afternoon, where the time limit is five hours. Moreover, further rules might also stipulate how the prize should be spent and in particular in the preferred embodiment the prize must be expended such that the winner does not own any assets from the expenditure of the prize after the time limit. Thus, for example, the prize must be expended on items such as services, hire, or the like, which must be consumed within the time limit. Further rules may also be made, examples of which are given below: Purchases should be legal, and may be specified as having to be made within a particular geographical region such as a particular country.

It may also be stipulated the purchases must be made at listed, published prices, and that it is not permissible for overcharged amounts to be made for any purchased items.

It may also be stipulated that the prize money may not be used to further bet or gamble, or to pay off loans, debts, or fines.

It may also be stipulated that winners must take part in any purchased activities or services, from start to finish.

It may also be stipulated that giving money away is not allowed, although a small contribution (e.g. up to 5%) may be given to an official charity.

Various other rules or stipulations may be made. During the expenditure of the prize the winner may be monitored by the competition holder, to ensure that the prize is being spent in accordance with the rules. Any prize money left over at the end of the time limit is preferably forfeited, and may be added, for example, to the prize pot if the competition is run again, for example the next day. The monitoring of the expenditure of the prize by the winner may be done in conjunction with a TV or radio production, whereby recordings either audio or visual of the winner expending the prize are made, and are then provided to third party viewers, for example, by broadcasting.

Figure 6:
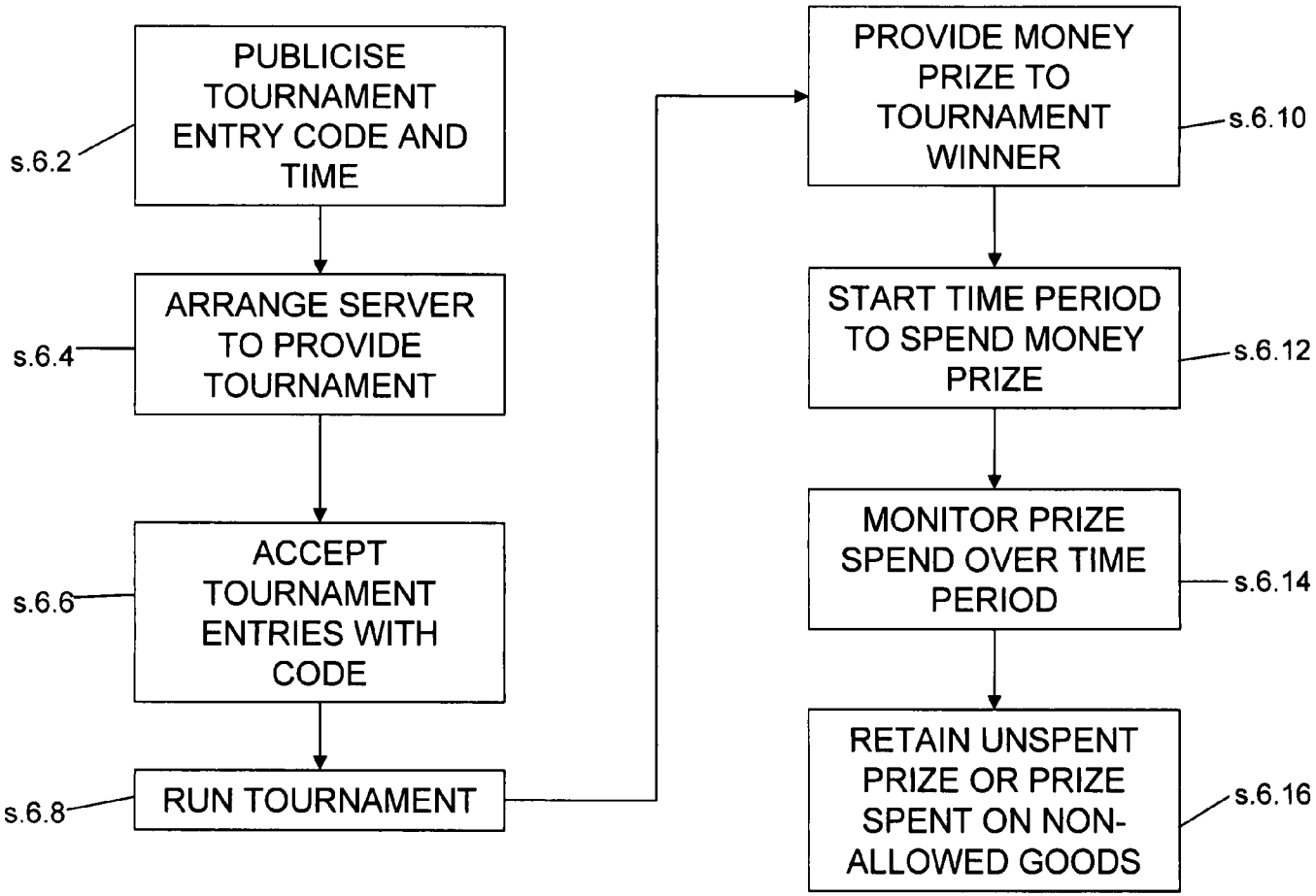
FIG. 6 is a flow diagram illustrating the steps involved in providing a game and prize according to embodiments of the invention.
Figure 7:
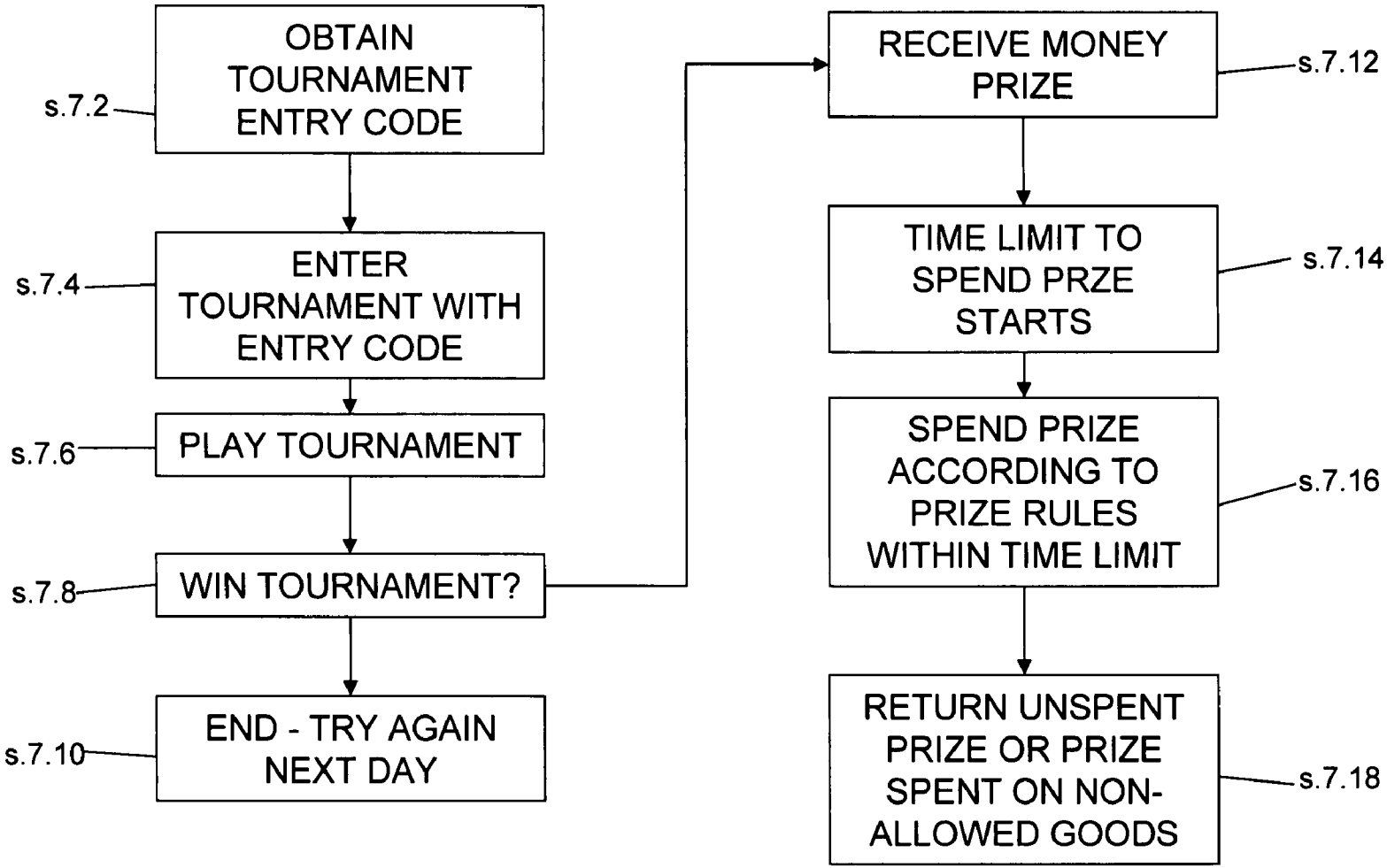
FIG. 7 is a flow diagram illustrating the steps performed by a player to play a game and obtain a prize in embodiments of the invention.

In view of the above description, FIGS. 6 and 7 illustrate flow diagrams specifying the steps performed by the game provider, and also by a player in the game. These are described next.

FIG. 6 illustrates the steps performed by a game provider, in providing the game. FIG. 6 assumes that the game provider is in possession of the game infrastructure, such as the backend server 16, and is able to provide the client program to users for installation on their local user computers 18, for example by download via the Internet.

At step 6.2, the first step provided by the game provider is that it must publicize the game, and the time at which the game is to be held. Additionally, it may be in the interests of the game provider to restrict entrance into the game tournament to players within a particular geographical region, for example within a single country. This can be done by providing for a tournament entry code, which is requested by the backend server when an individual client program tries to enter into the game. However, such that the target players know the tournament entry code, the tournament entry code should also be publicized, preferably at the same time as the actual tournament. For example, where the tournament is run in conjunction with a radio or TV show, the tournament entry code may be broadcast over the radio or TV channels to listening or watching users. Only those users within the geographical coverage of the radio or TV channel would then learn of the entry code.

Additionally, at step 6.4 the backend server 16 must be arranged to actually provide the tournament. This entails programming or otherwise configuring the server to provide the virtual poker game at the appropriate time, and to regulate entry thereinto by virtue of use of the tournament entry code.

At the appointed and advertised time at which the tournament is to be run, at step 6.6 the backend server is controlled to accept tournament entries with the valid code. Therefore, after step 6.6 the user computers 18 are logged in with the server 16, and the server 16 has instantiated the virtual poker games, and allocated users 18 thereto. Therefore, after step 6.6 the virtual poker games are ready to be played.

Therefore, following step 6.6 to step 6.8 the server 16 runs the tournament, and the users use their computers 18 to play the virtual poker game. As described previously, the virtual poker game is played in accordance with the usual rules of the particular variety of poker being played, until only one player remains, who is the winner.

Having determined the winner by running the tournament, at step 6.10 the game provider provides a money prize to the tournament winner. Please note that the money prize may be in the form of an actual cash prize transferred to the winner, or may instead be a promise to pay any charges incurred by the winner in spending the prize, up to the prize limit amount. Alternative forms of providing the money prize to the tournament winner may also be apparent, for example providing the tournament winner with a credit card having a limit of the prize amount, for the prize winner to spend during the set time period, or providing some other economically liquefiable mechanism, such as vouchers or the like. In this respect, therefore, the term "money" should be given its broad economic definition relating to a medium that can be exchanged for goods and services, and is used as a measure of their values on the market, rather than a narrow definition restricted to cash, credit cards or the like.

At the same time as providing the money prize to the tournament winner, the game provider also specifies the time limit in which the prize winner has to expend the prize, specifies the rules by which the prize money must be spent, and specifies any time period during which the money prize should be expended. The time limit is then started by the game provider at step 6.12.

While the winner is spending the money prize during the set time limit, the game provider preferably monitors the expenditure of the prize over the set time limit, at step 6.14. The monitoring is performed, for example, to ensure that the prize expenditure is performed in accordance with any stipulated rules, as discussed previously, and also, where the game is provided as part of an entertainment show, such as a TV or radio show, to allow viewers or listeners to the show to see how the winner is expending the prize. Thus, in preferred embodiments the monitoring of the prize spending may take the form of recording audio and/or video recordings of the winner expending the prize during the time limit, and providing any recorded footage to third parties, such as, for example, by broadcasting over usual TV, radio channels or Internet.

Once the time limit has expired, at step 6.16 the game provider retains any unspent prize, or retrieves any unspent money from the winner, and also preferably retrieves unspent prize or money for parts of the prize which are spent on non-allowed goods, against the stipulated rules. The game then ends.

Concerning the steps undertaken by a player, the corresponding method steps to the above are shown in FIG. 7. In particular, at step 7.2 the player hears about the game, and obtains the entry code to enter the game tournament. As discussed previously, the entry code may be broadcast over TV, radio channels or Internet, or may alternatively be provided on product purchased by the user.

At step 7.4 at the appointed time for the game to start the player enters the game tournament using the entry code, the entry comprising using the player's user computer 18 to access the backend game server 16 via the Internet, and logging on to the game tournament with the provided entry code. In this respect, it is assumed here that the user has installed on his computer any necessary software programs, such as the ParadisePoker.com™ client program, to allow the user computer 18 to contact the backend server 16, and to play the game.

Having entered the game tournament, at step 7.6 the user plays the game in accordance with the usual rules. Thus, where the game is poker, the player plays the poker tournament in accordance with the rules of the particular variant of poker which is being played. The user continues to play until he is either knocked out, in which case the user may try again the next day or the next time the game is played (as shown in step 7.10), or until the user has won the tournament. Thus, at step 7.8 an evaluation is made as to whether or not the player has won the tournament or not.

If the player does win the tournament, then at step 7.12 he receives a money prize from the game provider. As mentioned previously, the money prize may take several forms, including an actual cash prize, a promise to pay any debts incurred by the winner up to the prize amount, or the provision of a credit card or some other voucher type system up to the prize amount. At the same time as receiving the money prize the player is also informed of any stipulations as to how the prize should be expended, and the time limit and time period, if necessary, in which the prize expenditure must be undertaken. At step 7.14 the informed time limit begins, and the player then performs step 7.16, wherein he expends the prize according to any stipulated prize rules, within the time limit. As noted previously, in expending the prize the player may be monitored by the game provider, for example for a TV or radio show.

At step 7.18 the player returns any unspent prize or prize money spent on non-allowed goods at the end of the time limit. The player's participation in the game then ends.

As examples of allowable activities upon which the winner may expend the prize, and in particular in the case where the winner is not allowed to own any assets from the expenditure of the prize, the winner for example may hire any form of transport during the time limit, such as private jets, helicopters, or limousines; the winner may take people out to restaurants for meals, or hire private clubs for the entertainment of him or herself or other people; the winner may hire, for example, a celebrity to give a performance, and make that performance either private or open to other people; the winner may for example hire a football stadium, test track, or other facility and make it available to himself and other people for the time limit or the like. Generally, where the winner is not allowed to own assets he or she should contract for and consume services within the set time limit, or hire facilities, transport, or any other items, again only for the time limit.

Numerous variations may be made to the above described first embodiment to provide further embodiments of the invention. For example, in another embodiment instead of the game being played as a tournament all at once from beginning through to the winner, it may instead by played in two parts, with a first tournament being played to determine the top X number of players, wherein X is preferably in the range of between five and twelve, and then the top X players are invited to play the remainder of the tournament (the "final" round) at another time, for example live on a TV or radio show, to determine the winner. In such a case for the "final" round with the top X players additional players may be permitted to enter, for example so called "wild card" players, being players who entered the tournament but did not come in the top X of players, as well as other invited players, such as a TV or radio show host, or guest celebrities. The winner of the so-called "final" round then receives the money prize to spend within the time limit.

In a further embodiment, instead of not being able to spend the money prize on assets, the winner is able to spend the money prize on assets. In such a case, however, the winner may have a different time limit in which to spend the money, and preferably a shorter time limit than is the case where the winner must spend the money on services. In still further embodiments, a hybrid mechanism may be employed, where the winner is able to spend a proportion of the prize on assets, but the remainder of the prize should be spent such that no assets are available to show for the expenditure.

Moreover, in another embodiment, the time limit feature of the previously described embodiments is not applied, allowing the winner to spend the prize at his leisure. However, in this embodiment the prize is provided only on condition that the winner spend at least a proportion, and in some variants up to all of the prize, in such a manner that he has no assets to show for the expenditure. In this case the expenditure of the prize may still be monitored, as described previously, and particularly where the game forms part of a TV, radio, or Internet show. Various examples of how the winner may expend the prize, or at least the defined portion thereof, without having assets to show for the expenditure were described previously.

As a variation of the above described embodiments to provide further embodiments, where the game is played in two parts, with a "qualifying" round and a "final" round, if the game is repeated over a set period, for example daily, then a winner from an immediately previous game, if he has managed to spend the prize money in accordance with the rules within the set time limit, may be invited back to the "final" round of the subsequent game. In this way, a winner can continue to "roll over" from instance to instance of the game.

In a further embodiment based upon any of the above embodiments, instead of or in addition to stipulating rules with which the winner must comply concerning the expenditure of the money prize, in this embodiment a panel of third party judges may be appointed to direct the winner as to how the money must be expended. Such a feature is particularly preferable when the game is being incorporated as part of a TV, Internet or radio show, as it can add to the entertainment value. Moreover, the use of such a panel ensures variety in the choice of activities selected by winners, and ensures that winners from different instances of the game do not simply undertake the same activities as previous winners.

In this latter respect, in further embodiments the rules concerning expenditure of the money prize may stipulate that the money has to be expended in a different way from how previous winners of the game have expended the prize. Thus, for example, where a previous winner has already rented a private jet for the afternoon, a subsequent winner would not be permitted to perform the same activity. Such a feature ensures that the entertainment level of the game is kept relatively high, and is particularly important where the game is incorporated in a TV, Internet or radio show.

Even further modifications may be made to any of the above described embodiments to produce other embodiments. For example, though in the above described embodiments we have described the game as being a poker game, other games may be used, and in particular other card games. Additionally, the game selected may be either a "tournament" style game wherein the users play against each other, or may instead be games where a user plays individually against a simulated opponent with one of the plurality of users then be selected to be the winner. In this case, the selection of the winner may be made randomly, or may, for example, be based upon the player's performance against the simulated opponent. Thus, for example, where the game is a computer game against which a player plays individually, the winner may be that player which has achieved the highest score in the computer game.

Moreover, within the above described embodiments we have described the game as being an online game played using a user computer over the Internet, although in other embodiments this need not be the case and instead the game may be run in a more traditional manner, for example face to face over an actual poker table. Moreover, when the game is played over the Internet, any online gaming services may be used, and this invention is not restricted to the Paradise Poker.com™ or similar architectures designed previously.

Various other modifications will be apparent to the skilled person to produce other embodiments, all of which are intended to be encompassed by the appended claims.

The invention claimed is:

1. A method, comprising:

operating an on-line game server connected to the Internet, so as to:

host an on-line game for entry by players;

once players have entered the game, run the on-line game over the Internet according to game rules to determine at least one of the players as a winner of the on-line game;

award the winner a money prize;

set a time limit for the winner to expend the money prize; and monitor the expenditure of the money prize by the winner within the time limit;

wherein the monitoring comprises observing that the prize is spent within the time limit according to a set of rules and that the prize is expended such that the winner, at the end of the time limit, has no assets to show for the expenditure of the prize, and wherein the rules concerning expenditure of the money prize stipulate that the money has to be expended in a different way on different activities from how previous winners of the game have expended the prize.

2. A method according to claim 1, wherein the monitoring further comprises determining a mode of expenditure of the prize by the winner, and providing said winner with said mode of expenditure.

3. A method according to claim 2, and further comprising observing the expenditure of said winner in accordance with the determined mode of expenditure.

4. A method according to claim 1, and further comprising, providing a pass code to players, the pass code being for entry into the game, the game providing further comprising a step of obtaining the pass code from players prior to allowing entry into the game.

5. A method according to claim 1, wherein the monitoring further comprises recording audio and/or video recordings of said winner expending said prize.

6. A method according to claim 5, and further comprising transmitting said recordings to third parties via a communications medium.

7. A method according to claim 1, wherein the game is a tournament game against other players.

8. A method according to claim 1, wherein the game is a game against a simulated opponent, and the winner is selected from a plurality of people who play the game according to one or more predetermined criteria.

9. A method according to claim 8, wherein the winner is selected based on one of: at random; and player performance in the game.

10. A method according to claim 1, wherein the game is a card game.

11. A method according to claim 10, wherein the card game is a form of poker.

12. A method, comprising:

operating a computer connected to the Internet, so as to play an on-line game for a prize, the operating comprising communicating with an on-line game server hosting the on-line game via the Internet so as to:

enter the on-line game;

play the on-line game according to game rules with the object of trying to win the game;

if the game is won:

i) receiving a money prize; and then ii) expending the money prize within a set time limit;

wherein the expending step further comprises expending the prize within the time limit according to a set of rules and in a manner such that the winner, at the end of the time limit, has no assets to show for the expenditure of the prize, and wherein the rules concerning expenditure of the money prize stipulate that the money has to be expended in a different way on different activities from how previous winners of the game have expended the prize.

13. A method according to claim 12, and further comprising receiving information relating to a mode of expenditure of the prize, wherein the expending step comprises expending the prize in accordance with the mode of expenditure.

14. A method according to claim 12, and further comprising, receiving a pass code to access the game, the pass code being for entry into the game, the entering step further comprising a step of providing the pass code to obtain entry into the game.

15. A method according to claim 12, wherein the game is a tournament game against other players.

16. A method according to claim 12, wherein the game is a game against a simulated opponent, and the winner is selected from a plurality of people who play the game according to one or more predetermined criteria.

17. A method according to claim 16, wherein the winner is selected based on one of: at random; and player performance in the game.

18. A method according to claim 12, wherein the game is a card game.

19. A method according to claim 18, wherein the card game is a form of poker.

* * * * *

UNITED STATES PATENT AND TRADEMARK OFFICE

CERTIFICATE OF CORRECTION

PATENT NO. : 7,867,082 B2
APPLICATION NO. : 11/358595
DATED : January 11, 2011
INVENTOR(S) : Ismail Vali-Tepper It is certified that error appears in the above-identified patent and that said Letters Patent is hereby corrected as shown below:

Col. 9, claim 1, last paragraph, delete the phrase "in a different way".

Col. 10, claim 12, last paragraph, delete the phrase "in a different way".

Signed and Sealed this
Sixteenth Day of August, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,867,082 B2
APPLICATION NO. : 11/358595
DATED : January 11, 2011
INVENTOR(S) : Ismail Vali-Tepper It is certified that error appears in the above-identified patent and that said Letters Patent is hereby corrected as shown below:

Column 9, line 37 (Claim 1, line 20) delete the phrase "in a different way".

Column 10, line 32 (Claim 12, line 19) delete the phrase "in a different way".

This certificate supersedes the Certificate of Correction issued August 16, 2011.

Signed and Sealed this
Sixth Day of September, 2011

David J. Kappos

David J. Kappos
*Director of the United States Patent and Trademark Office*